US009180336B2

(12) United States Patent
Mohammed

(10) Patent No.: US 9,180,336 B2
(45) Date of Patent: Nov. 10, 2015

(54) VARIABLE FORCE MOUTH EXERCISER

(71) Applicant: Samir Mohammed, Tarpon Springs, FL (US)

(72) Inventor: Samir Mohammed, Tarpon Springs, FL (US)

( * ) Notice: Subject to any disclaimer, the term of this patent is extended or adjusted under 35 U.S.C. 154(b) by 60 days.

(21) Appl. No.: 14/202,981

(22) Filed: Mar. 10, 2014

(65) Prior Publication Data

US 2015/0251051 A1 Sep. 10, 2015

(51) Int. Cl.
*A63B 23/03* (2006.01)
*A63B 21/02* (2006.01)

(52) U.S. Cl.
CPC ..... *A63B 23/032* (2013.01); *A63B 21/023* (2013.01)

(58) Field of Classification Search
CPC ..... A63B 23/032; A63B 23/14; A63B 23/16; A63B 23/18; A63B 23/1236; A63B 21/05; A63B 21/023; A63B 21/0428; A63B 21/025; A61H 2205/026; A61H 2205/022; A61H 2201/1604
See application file for complete search history.

(56) References Cited

U.S. PATENT DOCUMENTS

| | | | | |
|---|---|---|---|---|
| 4,280,696 | A * | 7/1981 | Ramon | 482/11 |
| D591,367 | S * | 4/2009 | Harris | D21/684 |
| 2012/0283069 | A1 | 11/2012 | Martin et al. | |

* cited by examiner

*Primary Examiner* — Loan H Thanh
*Assistant Examiner* — Rae Fischer
(74) *Attorney, Agent, or Firm* — GrayRobinson P.A.; Michael J. Colitz, III

(57) ABSTRACT

The invention described herein relates to a mouth exerciser for providing a variable resistive force against which a user may exercise their mouth and jaw muscles. The apparatus may be selectively configured between a plurality of resistive force settings, thereby enabling a user to adjust their exercise routine as desired. The mouth exerciser may be particularly adapted to fit the topography of a particular user's oral cavity and may be easily disassembled for storage and transport.

3 Claims, 6 Drawing Sheets

VARIABLE FORCE MOUTH EXERCISER

TECHNICAL FIELD

This disclosure relates to an apparatus for strengthening jaw muscles. More particularly, the embodiments disclosed herein relate to an apparatus for providing a variable force against which a user's jaw muscles may be exercised.

BACKGROUND OF THE INVENTION

Mouth exercisers are known in the art. However, existing mouth exercisers often only permit a user to exercise their mouth and jaw at a single resistive force. Further, many mouth exercisers known in the art are only available as a "one-size-fits-all" type of device. Accordingly, when exercising at higher resistive forces, injury to the teeth, mouth, and face resulting from misalignment or slippage of the device may occur. Thus, a need exists in the art for a variable resistive force mouth exerciser that may be adapted to fit a user's particular mouth. The mouth exerciser of the present disclosure is aimed at overcoming this and other needs in the art.

SUMMARY OF THE INVENTION

The embodiments described herein relate to a mouth exerciser for providing a variable resistive force against which a user may exercise their jaw muscles.

The embodiments have several important advantages. For example, this disclosure provides a mouth exerciser that is adjustable between a plurality of resistive forces.

Another advantage includes providing a mouth exerciser that may be adapted to fit the topography of a particular user's oral cavity.

Yet another advantage includes providing at least one tension coil for providing a resistive force.

Still yet another advantage includes providing a mouth exerciser that may be disassembled for simplified storage.

The foregoing has outlined rather broadly the more pertinent and important features of the embodiments in order that the detailed description of the embodiments that follows may be better understood so that the present contribution to the art can be more fully appreciated. Additional features will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

| PARTS LIST | |
|---|---|
| 10 | mouth exerciser |
| 12 | mouthpiece |
| 14 | first end of mouthpiece |
| 16 | second end of mouth piece |
| 18 | arcuate extent of mouthpiece |
| 20 | upper surface of mouthpiece |
| 22 | lower surface of mouthpiece |
| 24 | raised ridge |
| 26 | mouthpiece tray |
| 28 | first end of tray |
| 30 | second end of tray |
| 32 | arcuate extent of tray |
| 34 | upper surface of tray |
| 36 | lower surface of tray |
| 38 | raised edges of tray |
| 40 | primary tension coil |
| 42 | first end of primary coil |
| 44 | second end of primary coil |
| 46 | coiled extent of primary coil |
| 48 | pin |
| 50 | lock washer |
| 52 | connector plate |
| 54 | first end of connector plate |
| 56 | second end of connector plate |
| 58 | aperture of connector plate |
| 60 | secondary tension coil |
| 62 | first end of secondary coil |
| 64 | second end of secondary coil |
| 66 | coiled extent of secondary coil |
| 68 | stabilizer plate |
| 70 | tension plate |
| 72 | tension adjustor |
| 74 | primary aperture of adjustor |
| 76 | secondary aperture of adjustor |
| 78 | detents of primary aperture |
| 80 | rail of primary tension coil |
| 82 | first orientation of adjustor |
| 84 | second orientation of adjustor |
| 86 | additional tension coil |
| 88 | first end of additional coil |
| 90 | second end of additional coil |
| 92 | coiled extent of additional coil |
| 94 | long stabilizer plate |
| 96 | long tension plate |
| 98 | second tension adjustor |
| 100 | first member of stabilizer plate |
| 102 | second member of stabilizer plate |
| 104 | locking pin |
| 106 | U member of stabilizer |
| 108 | locking plate |

DETAILED DESCRIPTION OF EMBODIMENTS

The present disclosure relates to a mouth exerciser apparatus 10 for strengthening a jaw. The various components of the present invention, and the manner in which they interrelate, are described in greater detail hereinafter.

In one embodiment of the invention depicted in FIGS. 1-6, the mouth exerciser 10 includes a pair of mouthpieces 12 capable of being molded to the upper and lower teeth, respectively, of the user. For example, each mouthpiece 12 may be comprised of any commercially available material that temporarily softens upon heating and subsequently re-hardens upon cooling. Thus, while in its soft form, a user may bite each respective mouthpiece 12 to conform or mold the mouthpiece to their individual bite prior to exercising. Further, it is envisioned that the mouthpieces 12 be removable for replacement, cleaning, and/or storage as desired.

Figure 1:
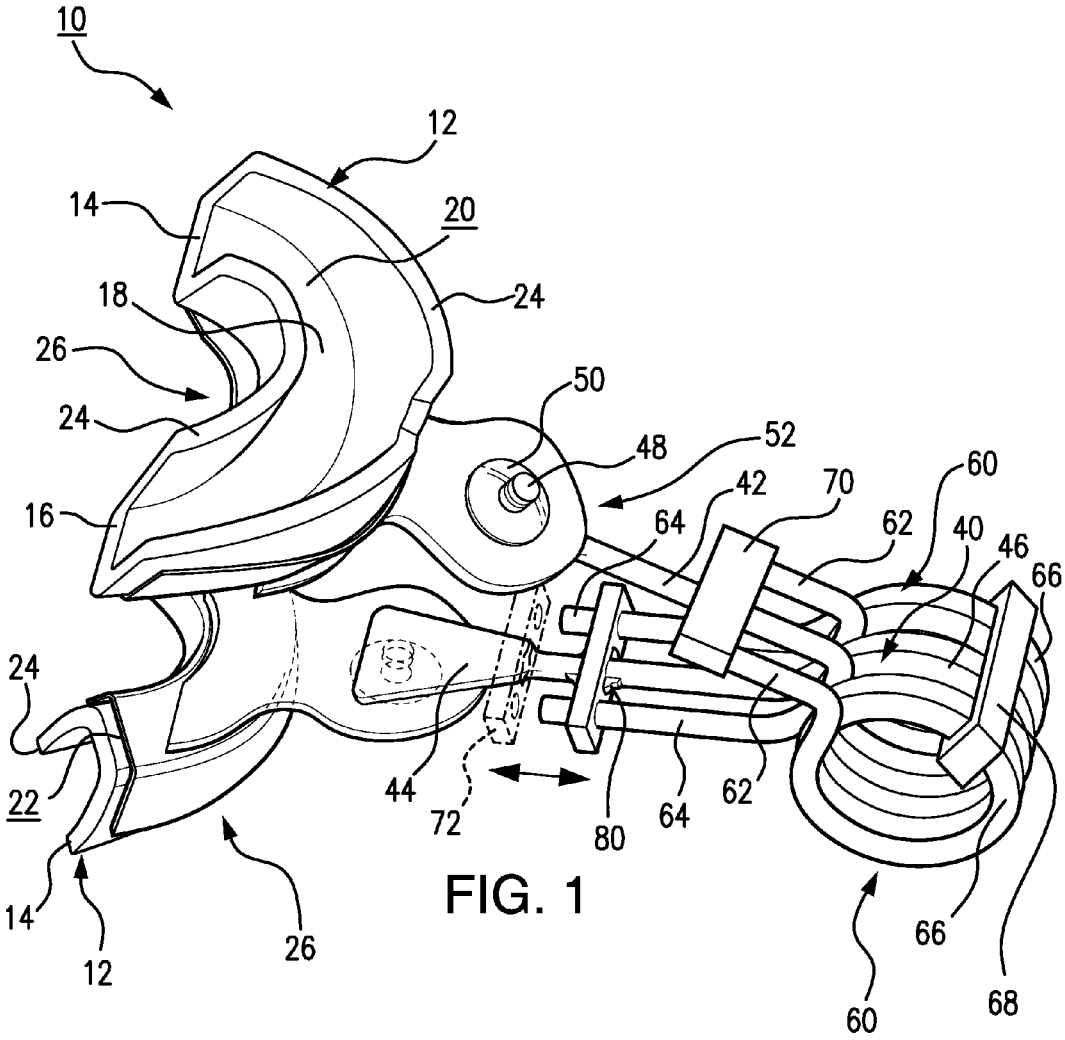
FIG. 1 is a side perspective view of an embodiment of the mouth exerciser of the present disclosure.

In the embodiment depicted in FIG. 1, each mouthpiece 12 includes a first end 14, a second end 16, and an arcuate extent 18 therebetween. Each mouthpiece 12 further comprises upper 20 and lower surfaces 22, the lower surface 22 being substantially flat and the upper surface including a pair of raised ridges 24 extending from the first end 14 to the second end 16. In one embodiment, the raised ridges 24 are defined by opposing side walls extending upward to an upper surface 20. Together the raised ridges 24 confine the forward and rearward surfaces of the user's upper and/or lower teeth.

Figure 2:
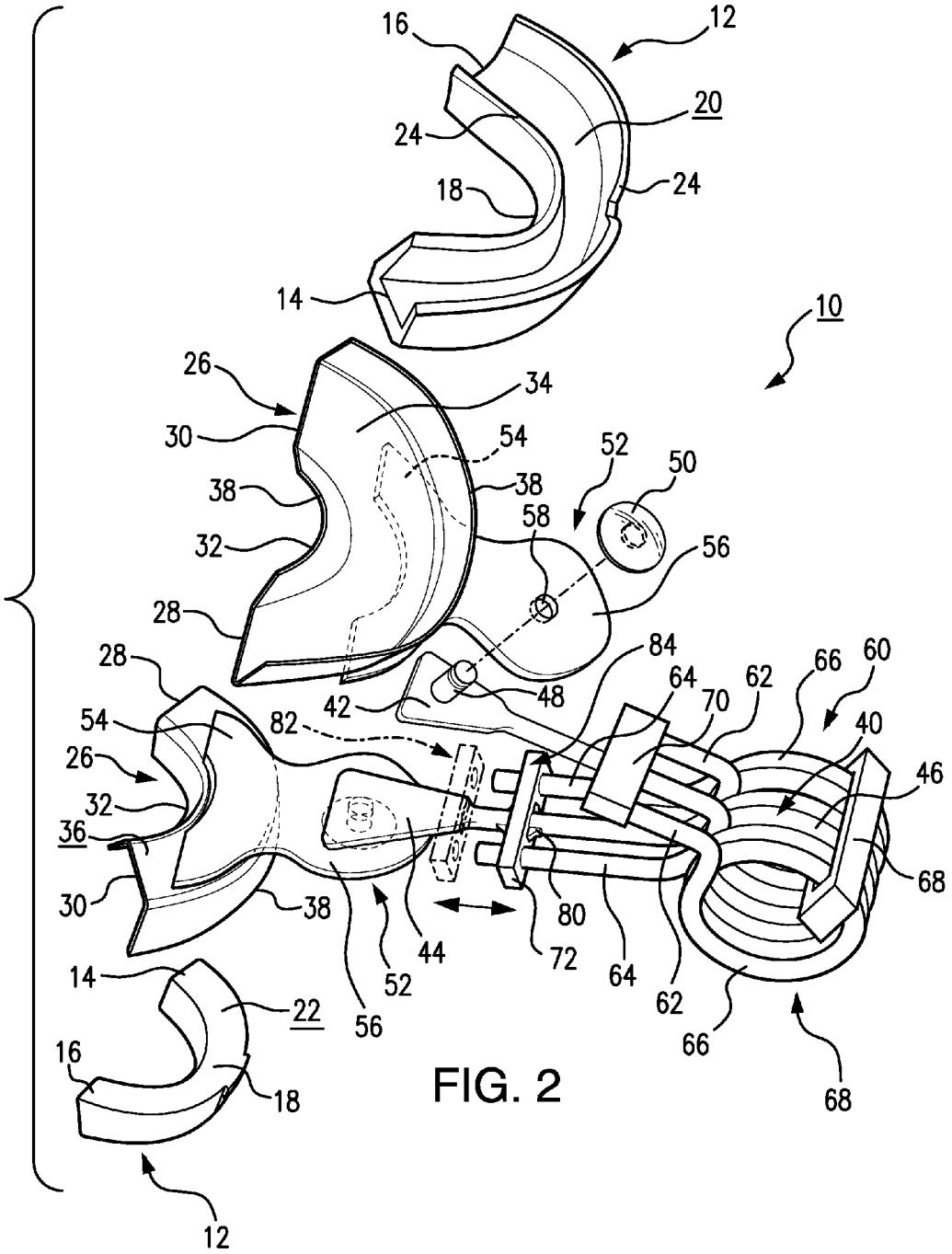
FIG. 2 is an exploded view of an embodiment of the mouth exerciser of the present disclosure.
Figure 3:
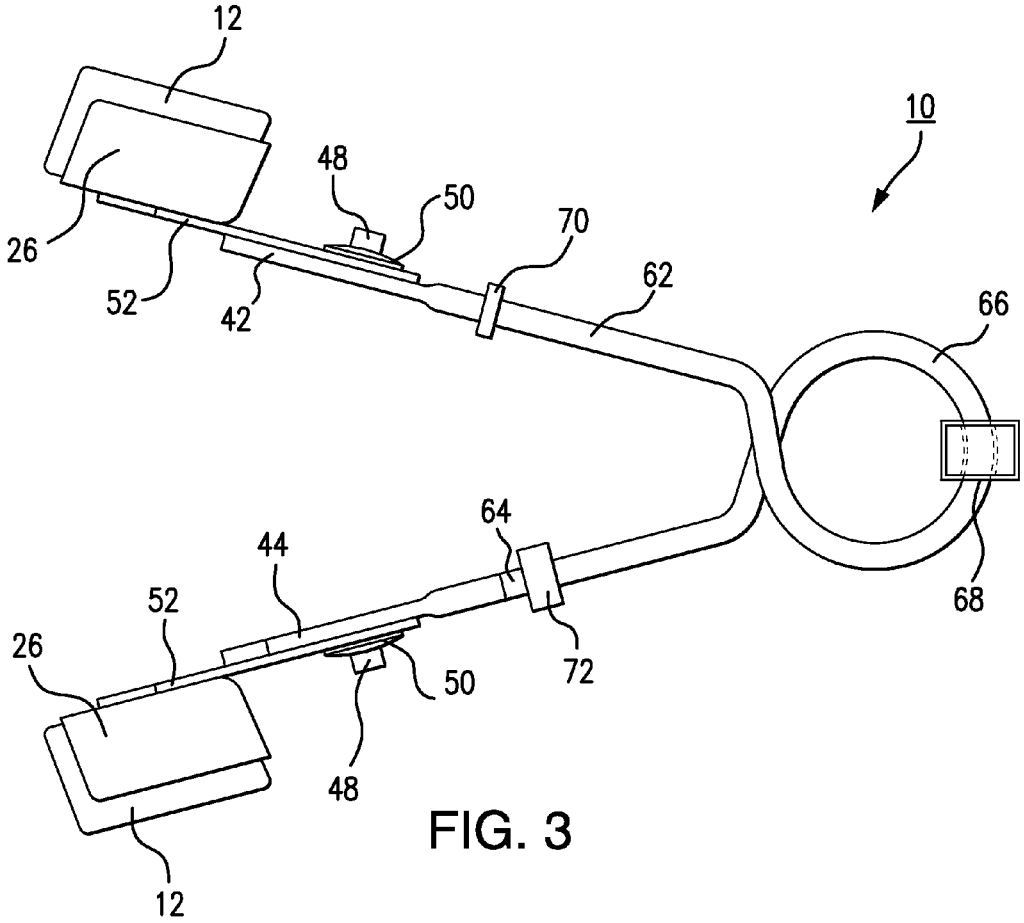
FIG. 3 is a side view of an embodiment of the mouth exerciser of the present disclosure.
Figure 4:
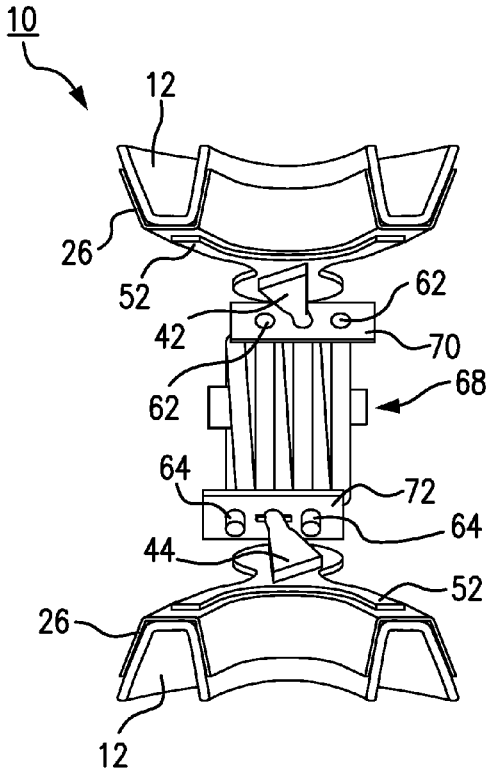
FIG. 4 is a front view of an embodiment of the mouth exerciser of the present disclosure.
Figure 5:
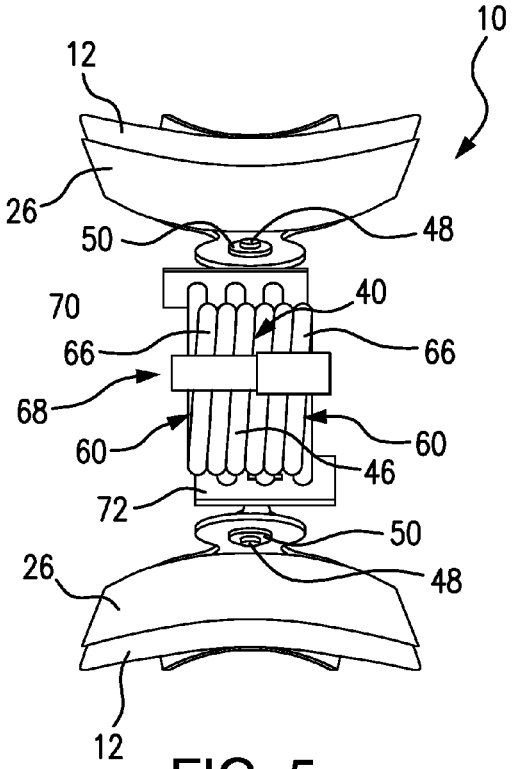
FIG. 5 is a rear view of an embodiment of the mouth exerciser of the present disclosure.

With reference now to FIG. 2, the mouth exerciser 10 of the present disclosure may include a pair of mouthpiece trays 26 for receiving a corresponding mouthpiece 12, each tray 26 including a first end 28, a second end 30, and an arcuate extent 32 therebetween. In one embodiment, the overall shape of each tray 26 is similar to that of each mouthpiece 12. Each tray 26 may further comprise an upper 34 and a lower surface 36, the lower surface 36 being substantially flat and the upper surface 34 including a pair of raised edges 38 extending from the first end 28 to the second end 30, wherein the lower surface 22 and the raised ridges 24 of each mouthpiece 12 are frictionally engaged to the upper surface 34 and the raised edges 38 of each tray, thereby holding each mouthpiece 12 in place. Any known means for situating the mouthpieces in place may be used, including but not limited to sticking, gluing, snapping, or other equivalent removeably connective means.

In order to provide a resistive force against which a mouth may be exercised and strengthened, an embodiment of the mouth exerciser 10 disclosed herein and depicted in FIG. 1-6, includes a primary tension coil 40 having a first end 42, a second end 44, and a coiled extent 46 therebetween. The tension coils described herein may be substituted with any number of resistive force-creating devices, including but not limited to springs, hydraulic cylinders, pneumatic cylinders, and the like. Accordingly, other resistive force-creating devices are considered to be within the scope of the present disclosure.

Each end of the primary tension coil 40 may include a pin 48 or other connector means for operably coupling the primary tension coil 40 to each mouthpiece tray 26 prior to use. In the embodiments depicted in FIGS. 1-6, the mouth exerciser 10 disclosed herein further includes a pair of connector plates 52 for coupling the mouthpiece trays 26 to the primary tension coil 40, each connector plate 54 having a first end 54 and a second end 56, the first end 54 of each plate 52 connected to the lower surface 36 of the corresponding tray 26 and the second end 56 of each plate 52 including an aperture 58. Each pin 48 may be removeably positioned through the aperture 58 of the corresponding connector plate 52 for forming a physical link between the primary tension coil 40 and the corresponding mouthpiece tray 26. The pin 48 may be secured to the tray 26 by a lock washer 50 or other equivalent securing means, including but not limited to a threaded nut, a clip, a secondary tension pin, and the like.

Exemplary embodiments of the primary tension coil 40 described herein has first and second (i.e. decompressed and compressed) orientations. In the first orientation the distance between the first 42 and second 44 ends is greater than in the second orientation. In the embodiments depicted herein, the primary tension coil 40 is biased in the first orientation, thereby providing a first resistive force against which a user may exercise their jaw. Thus, a user must overcome the force of this biased first orientation by biting down on the mouthpieces 12 of the apparatus 10 to achieve the second orientation, thereby exercising their mouth and jaw muscles.

For selectively providing a second resistive force against which the mouth is exercised, the embodiments of the mouth exerciser 10 depicted in FIGS. 1-6 includes a pair of secondary tension coils 60 having a first end 62, a second end 64, and a coiled extent 66 therebetween. In the embodiments depicted herein, the secondary coils 60 each adopt the same general configuration as the primary tension coil 40, but the second ends 64 of each secondary coil 60 are slightly shorter in length than the second ends 44 of the primary tension coil 40.

Figure 8A:
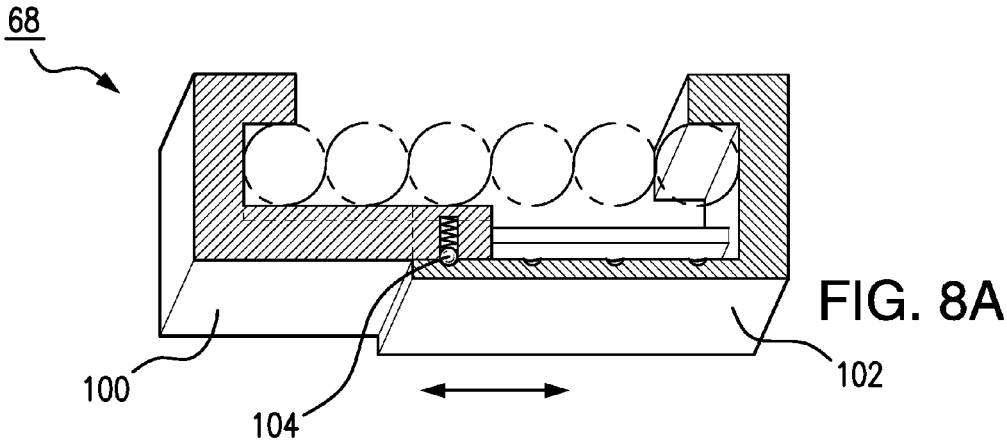
FIG. 8A is a top perspective view of an embodiment of a stabilizer plate of the present disclosure.
Figure 8B:
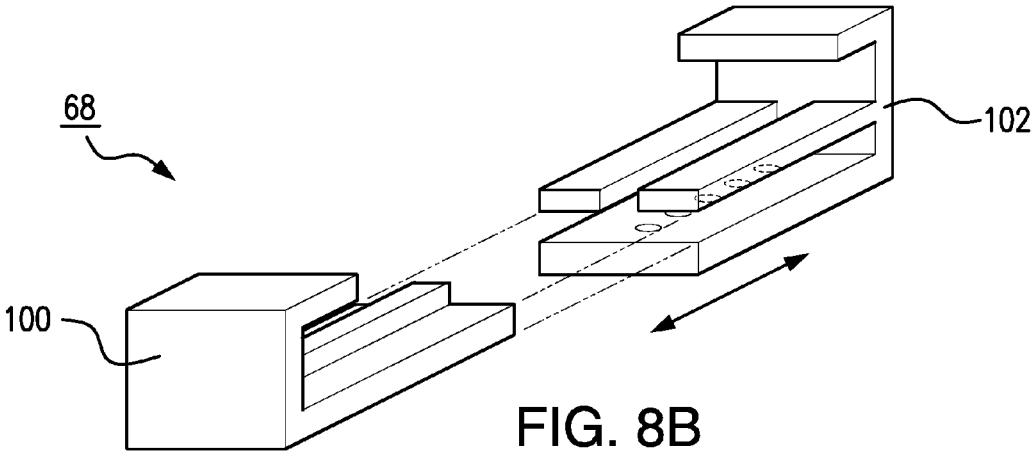
FIG. 8B is an partial exploded perspective view of the embodiment of a stabilizer plate depicted in FIG. 8A.
Figure 8C:
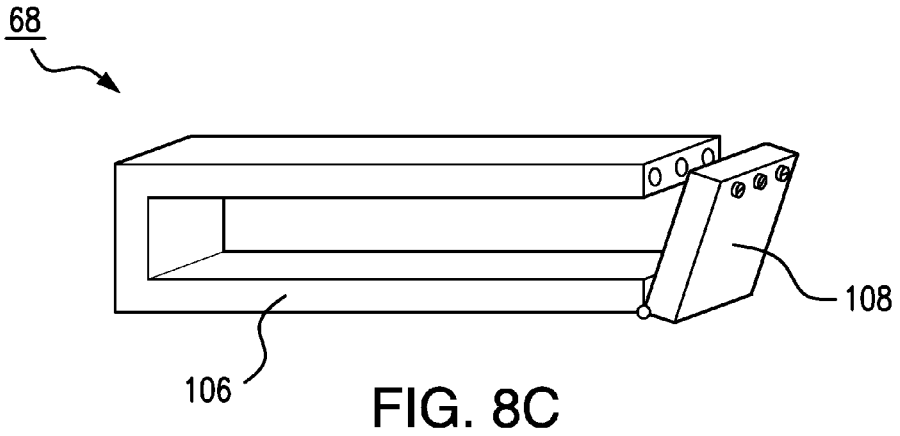
FIG. 8C is another embodiment of a stabilizer plate of the present disclosure.

The secondary coils 60 may be secured adjacent the primary coil 40 by a stabilizer plate 68. FIGS. 8A-8C depict various exemplary embodiments of the stabilizer plate 68 of the present disclosure. In one embodiment, the stabilizer plate 68 may be telescopic as depicted in FIGS. 8A and 8B, which allows for accommodating additional tension coils by either increasing or decreasing the width of the stabilizer plate 68 as desired. A telescopic embodiment may include a first member 100 slidably received by a second member 102, the two members being held in place by a locking pin 104. In another embodiment, such as that depicted in FIG. 8C, the stabilizer plate 68 may be selectively opened on one end and placed around the coils. For example, the stabilizer plate 68 may include a U member 106 and a hinged locking plate 108. The locking plate 108 may be held in a closed position by a series of screws, pins, or other means for stably locking the stabilizer plate 68.

In a manner similar to that described herein for the primary tension coil 40, each secondary coil 60 also has first and second orientations. The first orientation (i.e. decompressed orientation) of each secondary coil 60 is characterized by having a greater distance between the first 62 and second 64 ends than the second (i.e. compressed) orientation. The secondary tension coils 60 are also biased in the first orientation. Because the secondary tension coils 60 are shorter than the primary tension coil 40, greater force is required to achieve the second, compressed orientation.

Figure 7:
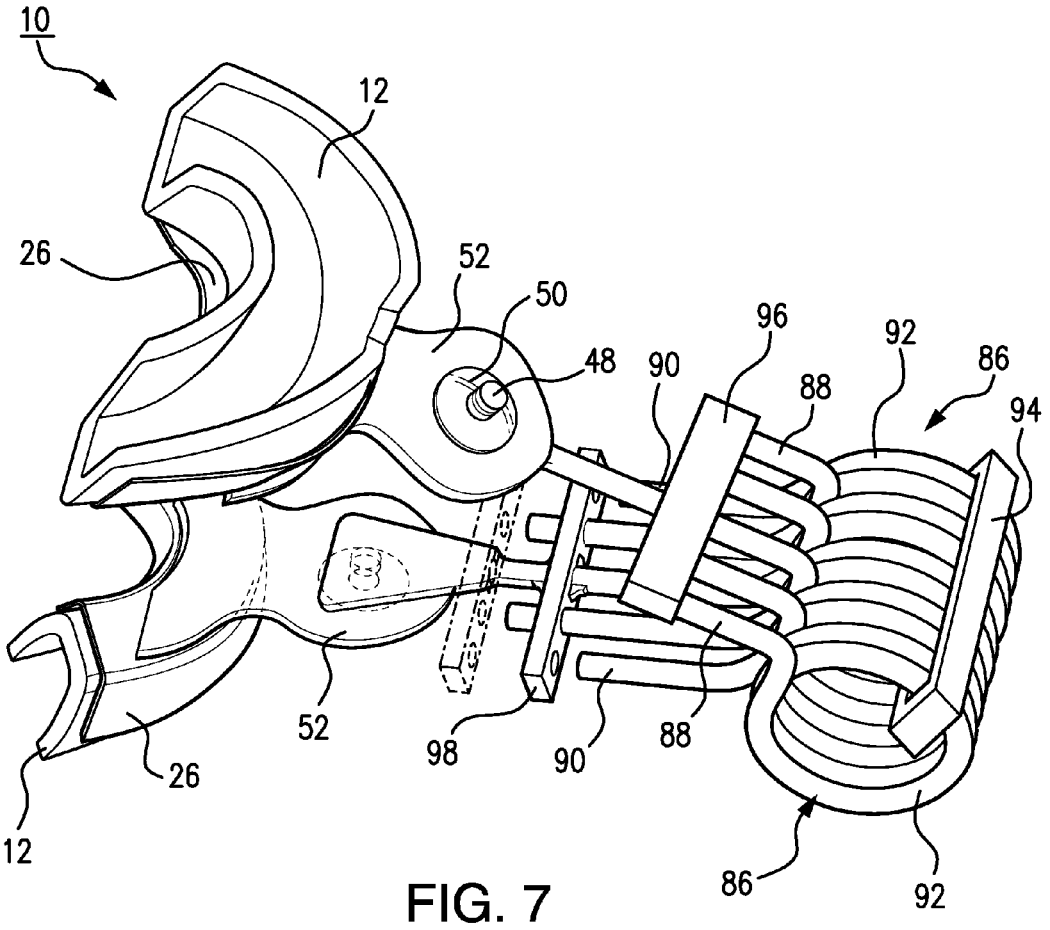
FIG. 7 is a perspective view of an alternative embodiment of the mouth exerciser of the present disclosure.

Additional coils 86 may be used to further increase the resistive force of the mouth exerciser 10 described herein. As depicted in FIG. 7, the second ends 90 of any additional coils 86 may be shorter than the second ends 64 of the secondary coils 60, thereby providing an additional resistive force setting beyond the first and second resistive force settings. The use of additional coils having additional coiled extents 92 may necessitate a need for a longer stabilizer plate 94, a longer tension plate 96, and a second tension adjustor 98, the functions and characteristics of which are described in greater detail hereinafter.

Further, the use of secondary and/or additional coils of a length similar to that of the primary coil, but having a greater resistance to movement from the biased orientation than the primary coil, may also be used to achieve the objectives of the embodiments described herein.

The embodiment depicted in FIGS. 1-6 further comprises a rectangular tension plate 70 operably engaging the first ends 42, 62 of the primary 40 and each secondary 60 tension coil so that the first ends 40, 62 remain stationary relative to one another during compression and decompression of the coils when exercising. In another embodiment, the tension plate 70 may be slidably adjustable along the first end 42 of the primary tension coil 40 and the first ends 62 of each secondary tension coil 60. In yet another embodiment, the tension plate 70 may be replaced by a second tension adjustor 72 that slidably engages the first end 42 of the primary tension coil 40 and the first ends 62 of each secondary tension coil 60 substantially as described herein.

Figure 6:
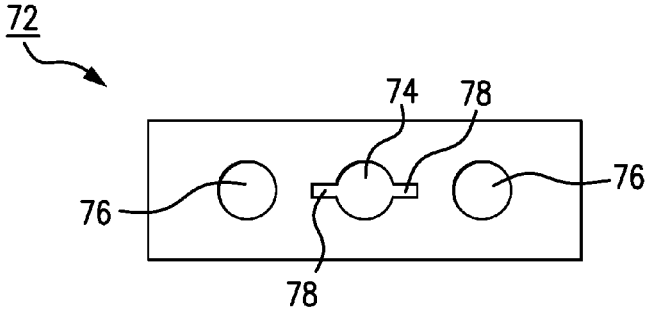
FIG. 6 is a front view of an embodiment of the tension adjustor of the present disclosure.

In the embodiments depicted in FIG. 1-6, a tension adjustor 72 is provided for engaging the second ends 44, 64 of the primary 40 and secondary 60 tension coils. One embodiment of the tension adjustor 72 is depicted in FIG. 6. The tension adjustor 72 may be generally rectangular in shape and include a primary aperture 74 and a pair of secondary apertures 76. Embodiments providing for the use of additional tension coils beyond the primary and secondary coils necessitates a need for additional apertures formed within the tension adjustor for selectively engaging the additional coils (see FIG. 7).

In one embodiment, the primary aperture 74 of the tension adjustor 72 is slidably received by the second end 44 of the primary tension coil 40 and includes a pair of detents 78 for engaging at least one ridge or rail 80 formed along the second end 44 of the primary tension coil 40. The interactions between the detents 78 of the tension adjustor 72 and the ridges or rails 80 of the primary tension coil 40 serve to prevent rotation of the tension adjustor 72 about the primary tension coil 40 and maintain the tension adjustor's 72 alignment with the second ends 64 of the secondary tension coils 60 when selective engagement of the secondary tension coils 60 is desired. The interaction between the detents 78 and the ridges 80 further prevent the tension adjustor 72 from sliding along the length of the second end 44 of the primary coil 40 while exercising, thereby maintaining the mouth exerciser 10 in the selected resistive-force setting.

In one variable resistive force embodiment of the present invention, the tension adjustor 72 has a first orientation 82 and a second orientation 84 (see FIG. 2). In the first orientation 82 the tension adjustor 72 engages only the second end 44 of the primary tension coil 40. In the second orientation 84, the tension adjustor 72 engages both the second end 44 of the primary tension coil 40 and the second ends 64 of each secondary tension coil 60, thereby increasing the resistive force against which the mouth and jaw muscles may be exercised. Thus, a user may increase or decrease the resistive force against which their mouth and jaw muscles are exercised by configuring the tension adjustor 72 accordingly.

It is envisioned that the various components of the embodiments of invention described in FIGS. 1-7 may be removable, interchangeable, and replaceable. The mouth exerciser may be provided as a kit of disassembled parts which may be assembled according to the desired number of tension coils. A series if stabilizer plates, tension plates, and tension adjustors for accommodating the selected number of coils may be provided. The kit may further include a storage case or bag for transport of the various components of the embodiments of the mouth exerciser described herein.

Although this disclosure has been described in terms of certain embodiments and generally associated methods, alterations and permutations of these embodiments and methods will be apparent to those skilled in the art. Accordingly, the above description of example embodiments does not constrain this disclosure. Other changes, substitutions, and alterations are also possible without departing from the spirit and scope of this disclosure.

What is claimed is:

1. An apparatus for strengthening a jaw, the apparatus comprising:

a pair of mouthpieces, each mouthpiece comprising a first end, a second end, and an arcuate extent therebetween, each mouthpiece further comprising upper and lower surfaces, the lower surface being substantially flat and the upper surface including a pair of raised ridges extending from the first end to the second end;

a pair of mouthpiece trays, each mouthpiece tray having a first end, a second end, and an arcuate extent therebetween, each mouthpiece tray further comprising upper and lower surfaces, the lower surface being substantially flat and the upper surface including a pair of raised edges extending from the first end to the second end, each mouthpiece tray receiving a corresponding mouthpiece, wherein the lower surface and the raised ridges of each mouthpiece are frictionally engaged to the upper surface and the raised ridges of each mouthpiece tray, thereby holding each mouthpiece in place;

a pair of connector plates, each connector plate having a first end and a second end, the first end of each connector plate connected to the lower surface of one of the mouthpiece trays and the second end of each plate including an aperture;

a primary tension coil having a first end, a second end, and a coiled extent therebetween, each end including a pin, each pin removeably positioned through the aperture of the corresponding connector plate, at least a portion of the second end of the primary tension coil including a pair of grooves formed along its length, the primary tension coil having first and second orientations, the first orientation having a greater distance between the first and second ends than the second orientation, the primary tension coil biased in the first orientation;

a pair of secondary tension coils having a first end, a second end, and a coiled extent therebetween, each secondary tension coil positioned adjacent the primary tension coil and having first and second orientations, the first orientation having a greater distance between the first and second ends than the second orientation, the secondary tension coils biased in the first orientation;

a rectangular tension plate fixedly connecting the first ends of the primary and each secondary tension coil; and a tension adjustor having a primary aperture and a pair of secondary apertures, the primary aperture slidably received by the second end of the primary tension coil and including a pair of detents engaging the grooves of the primary tension coil, the tension adjustor having a first orientation and a second orientation, wherein in the first orientation the tension adjustor engages only the second end of the primary tension coil, and wherein in the second orientation the tension adjustor further engages the second ends of the secondary tension coils.

2. The apparatus as described in claim 1, wherein the mouthpieces are molded to a user's mouth.

3. The apparatus as described in claim 1 further configured to be disassembled for ease of storage.

* * * * *